US010779092B2

(12) United States Patent
Jürg et al.

(10) Patent No.: US 10,779,092 B2
(45) Date of Patent: Sep. 15, 2020

(54) HEARING DEVICE AND HEARING SYSTEM AS WELL AS METHOD FOR OPERATING A HEARING DEVICE

(71) Applicant: Sonova AG, Staefa (CH)

(72) Inventors: Sudan Jürg, Gündisau (CH); Aazami Sahba, Founex (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 16/327,352

(22) PCT Filed: Aug. 26, 2016

(86) PCT No.: PCT/EP2016/070205
§ 371 (c)(1),
(2) Date: Feb. 22, 2019

(87) PCT Pub. No.: WO2018/036638
PCT Pub. Date: Mar. 1, 2018

(65) Prior Publication Data
US 2019/0222944 A1 Jul. 18, 2019

(51) Int. Cl.
*H04R 25/00* (2006.01)
*H04R 1/10* (2006.01)

(52) U.S. Cl.
CPC ..... *H04R 25/55* (2013.01); *H04R 1/1025* (2013.01); *H04R 25/305* (2013.01); *H04R 25/556* (2013.01); *H04R 2225/31* (2013.01); *H04R 2460/03* (2013.01)

(58) Field of Classification Search
CPC ..... H04R 1/1025; H04R 2225/31; H04R 2460/03; H04R 25/305; H04R 25/55; H04R 25/556
USPC ..... 381/323
See application file for complete search history.

(56) References Cited

U.S. PATENT DOCUMENTS

| | | | |
|---|---|---|---|
| 3,354,271 | A | 11/1967 | McDermaid |
| 8,334,677 | B2 | 12/2012 | Single |
| 9,192,772 | B1 | 11/2015 | Tsukamoto et al. |
| 2002/0076071 | A1 | 6/2002 | Single |
| 2013/0103114 | A1 | 4/2013 | Single |
| 2014/0079236 | A1 | 3/2014 | Yamkovoy |
| 2015/0115871 | A1 | 4/2015 | Feril |

FOREIGN PATENT DOCUMENTS

| | | | |
|---|---|---|---|
| EP | 2876777 | A1 | 5/2015 |
| WO | 2006/071210 | A1 | 7/2006 |
| WO | 2015/065988 | A1 | 5/2015 |

OTHER PUBLICATIONS

European Patent Office, Written Opinion and Search Report, PCT/EP2016/070205, pp. 1-16, European Patent, P. B., 5818 Patentlaan 2, NL-2280 HV Rijswijk.

*Primary Examiner* — Phylesha Dabney

(57) ABSTRACT

The present invention pertains to a rechargeable hearing device (1). The proposed hearing device (1) comprises a power supply system (6) with a control unit (10) adapted to control operation of a sound system (2) of the hearing device (1) dependent on a control input signal, wherein the control input signal depends on a type information provided by an external power source (11) indicative of the type of external power source (11) from which the hearing device (1) is receiving a power signal. Moreover, the present invention provides a hearing system (100) comprising such a hearing device (1) and an external power source (11) as well as a method for operating such a hearing device (1).

8 Claims, 2 Drawing Sheets

HEARING DEVICE AND HEARING SYSTEM AS WELL AS METHOD FOR OPERATING A HEARING DEVICE

TECHNICAL FIELD

The present invention relates to a rechargeable hearing device and a method for operating such a hearing device. The present invention further pertains to a hearing system comprising the proposed hearing device as well as an external power source for providing power to the hearing device.

BACKGROUND OF THE INVENTION

In the context of the present invention the term "hearing device" refers to hearing aids (alternatively called hearing instruments or hearing prostheses) used to compensate hearing impairments of hard of hearing persons as well as to audio and communication devices used to provide sound signals to persons with normal hearing capability, e.g. in order to improve hearing in harsh acoustic surroundings. Such hearing devices are miniature ear-level devices which are typically employed for extended periods of time and are powered by small batteries such as a zinc air button cell. Zinc air batteries provide a high energy capacity in a small package size. However, they usually need to be replaced quite often, for instance every few days in the case of a hearing aid being used many hours per day by a hearing impaired person. The handling of such tiny batteries when trying to replace a depleted battery of a small hearing aid with a full one is especially challenging and time consuming for elderly people who have lost their manual dexterity and possess reduced vision, as commonly occurs with ageing. Therefore, rechargeable batteries such as for instance a nickel metal hydride (NiMH) or a lithium ion accumulator are increasingly being utilised in hearing devices. However, rechargeable batteries have a lower capacity than zinc air batteries and consequently can power a hearing device for a reduced period of time. Hence, it can happen that a hearing device runs out of power for example when the user is travelling or when he forgot to recharge the battery overnight. These situations are obviously very inconvenient for the user, because he often critically depends on a working hearing device to improve his hearing capability.

Thus there is a need for appropriate means that help a user to ensure that his hearing device has sufficient power whenever it is required.

SUMMARY OF THE INVENTION

It is therefore an object of the present invention to provide an improved rechargeable hearing device that ensures that the hearing device has sufficient power whenever it is needed by the user. This object is achieved by the hearing device according to claim 1.

Moreover, it is a further goal of the present invention to provide a hearing system comprising a hearing device and an external power source suitable for providing power to the proposed hearing device. This aim is achieved by the hearing system specified in claim 6.

A further object of the present invention is to provide a method for operating the proposed hearing device ensuring that sufficient power is available whenever required. This object is achieved by the method comprising the steps listed in claim 10.

Specific embodiments of the hearing device, hearing system and operating method according to the present invention are given in the dependent claims.

The present invention provides a hearing device with a sound system, said sound system comprising:

- an input transducer providing an input audio signal;
- a signal processing unit adapted to process the input audio signal and provide a processed audio signal; and
- an output transducer adapted to output the processed audio signal to a user of the hearing device, the hearing device further comprising a power supply system comprising:

- a battery providing a battery voltage, said battery in particular being a rechargeable battery;
- a power module adapted to receive a power signal from an external power source;
- a power management unit adapted to receive power from either the power module or the battery, to provide power to the sound system, and to charge the battery when a power signal is being received from the external power source; and
- a control unit adapted to control operation of the sound system by means of a control output signal dependent on a control input signal, wherein the control input signal depends on a type information indicative of the type of the external power source from which the power module is receiving the power signal.

With the proposed hearing device it is possible to adapt the operation of the sound system in dependence of the type of the external power source delivering power to the hearing device.

In an embodiment of the hearing device the control input signal is provided to the sound system, in particular to the signal processing unit, as well as to the power management unit.

Moreover, charging of the battery can be optimised depending on the type of the external power source.

In a further embodiment of the hearing device the type information is derived from at least one of:

- the power signal;
- a user input provided by the user via a user interface, e.g. a signal output by the user interface in response to the user input provided by the user via the user interface;
- a signal provided by a sensor comprised in the hearing device, the sensor being adapted to detect information from (such as a presence of) an identification module comprised in the external power source and adapted to provide the type information.

In a further embodiment of the hearing device the power management unit is adapted to support at least two of the following modes of operation:

- provide power from the power module to the battery to charge the battery and simultaneously provide power to and enable the sound system;
- provide power from the power module to the battery to charge the battery and disable the sound system, e.g. by not providing power to the sound system or by putting the sound system in a sleep/standby mode (with reduced power consumption);
- provide power from the battery to power and enable the sound system, wherein the mode of operation to be employed is selected dependent on the control output signal.

It is also conceivable to additionally select a mode of operation where power is provided from the power module only to power to the sound system and not simultaneously to the battery in order to charge the battery. In such a mode of operation the external power source takes on the role of the battery of the hearing device, in particular if the battery in the hearing device is not rechargeable.

In a further embodiment of the hearing device the sound system is further adapted to adjust the processing performed by the signal processing unit dependent on the control output signal, e.g. to enable or disable certain functions performed by the signal processing unit, such that the power consumption of the signal processing unit is adaptable, for instance reducible, dependent on available power.

In a further embodiment of the hearing device the power module is adapted to receive the power signal from the power source via a charging cable, for instance a universal serial bus (USB) cable, or wirelessly, for instance by means of inductive or capacitive coupling.

In a further aspect, the present invention provides a hearing system comprising a hearing device as specified above and an external power source for providing power to the hearing device, wherein the external power source is adapted to provide a power signal and a type information indicative of the type of the external power source.

In an embodiment of the hearing system the type information is conveyed by the power signal, e.g. is provided as a modulation of the power signal.

In a further embodiment of the hearing system the external power source comprises an identification module comprising at least one of:

a magnetic field generator, in particular a magnet;

an electric field generator;

a light source;

a radio frequency identification (RFID) chip.

In a further embodiment of the hearing system the external power source is adapted to provide the power signal to the hearing device via a charging cable, for instance a universal serial bus (USB) cable, or wirelessly, for instance by means of inductive or capacitive coupling.

In a further embodiment of the hearing system the external power source is structured and configured as a stationary unit, such as a desktop unit, wherein the external power source is in particular required to be connected with mains electric power whilst providing power to the hearing device.

In a further embodiment of the hearing system the external power source comprises a receptacle for receiving the hearing device for charging.

In a further embodiment of the hearing system the external power source is structured and configured as a mobile, portable or wearable unit, and in particular adapted to provide power to the hearing device independent of mains electric power whilst operationally connected with the hearing device, and wherein the external power source is connectable to a power supply, said power supply being one of:

a battery pack, a USB port, a solar module, e.g. a photovoltaic cell.

In a further embodiment of the hearing system the external power source comprises a housing in which for instance a battery pack is arranged and a charging adapter adapted to be attached to the hearing device for charging the hearing device, wherein the charging adapter and the battery pack are connected via cable.

In a further embodiment of the hearing system the power signal is provided from the charging adapter to the hearing device wirelessly, for instance by means of inductive or capacitive coupling.

In a further embodiment of the hearing system the portable/wearable charging adapter is adapted to be arranged at least partly behind an ear of the user.

In a further aspect, the present invention provides a method for operating the hearing device as specified above, e.g. with a sound system, said sound system comprising an input transducer providing an input audio signal, a signal processing unit adapted to process the input audio signal and provide a processed audio signal, and an output transducer adapted to output the processed audio signal to a user of the hearing device, the hearing device further comprising a power supply system comprising a battery, a power module adapted to receive a power signal from an external power source, a power management unit adapted to receive power from either the power module or the battery, to provide power to the sound system, and to charge the battery when a power signal is being received from the external power source, and a control unit adapted to control operation of the sound system, said method comprising the steps:

detecting a presence of a power signal provided by the external power source;

determining a type information indicative of the type of the external power source from which the hearing device, in particular the power module, is receiving the power signal; and operating the hearing device in dependence of the type information.

In an embodiment of the method the hearing device is adapted to support at least two of the following modes of operation:

provide power from the external power source to the battery of the hearing device to charge the battery and simultaneously provide power to and enable the sound system of the hearing device;

provide power from the external power source to the battery to charge the battery and disable the sound system, e.g. by not providing power to the sound system or by putting the sound system in a sleep/standby mode (with reduced power consumption);

provide power from the battery to power and enable the sound system, wherein the mode of operation to be employed is selected dependent on the type information.

In a further embodiment of the method operating the sound system comprises adjusting a processing performed by the signal processing unit of the sound system dependent on the type information, e.g. enabling or disabling certain functions performed by the signal processing unit, such that the power consumption of the signal processing unit is adapted, for instance reduced, dependent on available power.

In a further embodiment of the method operating a change of mode of operation is notified to the user of the hearing device.

It is to be noted that combinations of the individual embodiments mentioned above may result in even further embodiments of the present invention unless the combined features stand in contradiction.

BRIEF DESCRIPTION OF THE DRAWINGS

The present invention is further explained below by means of non-limiting specific embodiments and with reference to the accompanying drawings, which show.

The same reference signs are employed in the figures when referring to identical or similar elements.

DETAILED DESCRIPTION OF THE INVENTION

Figure 1:
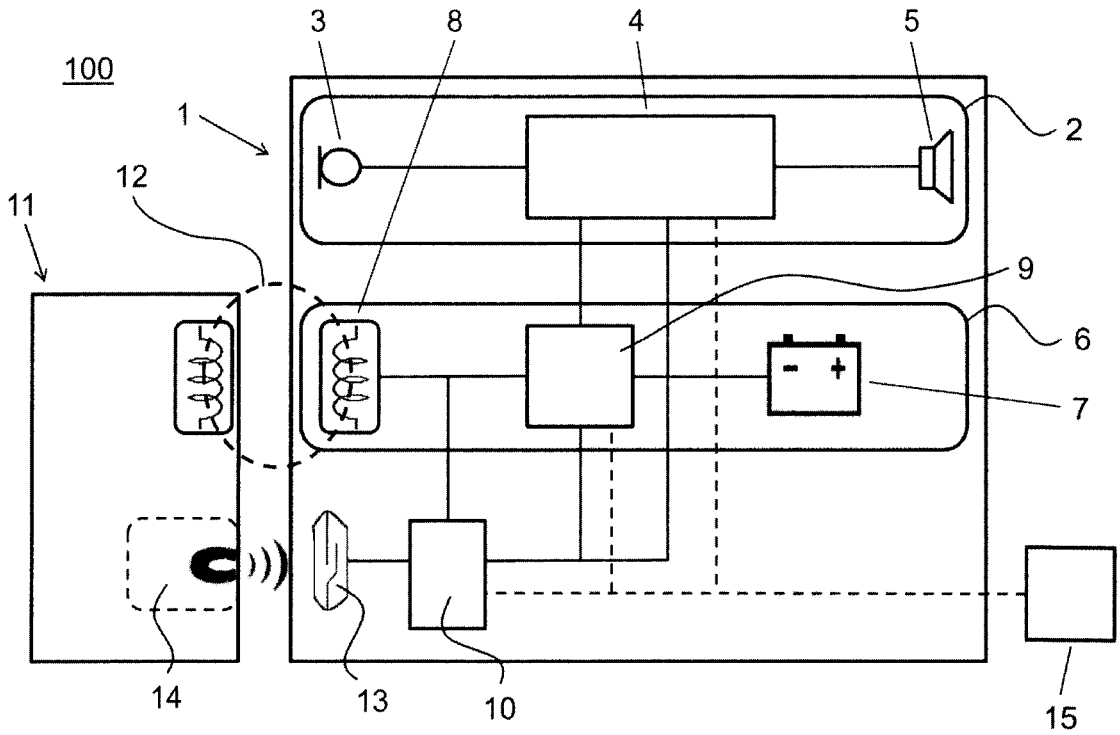
FIG. 1 depicts a schematic block diagram of an embodiment of a hearing system according to the present invention.

FIG. 1 illustrates the basic building blocks of a hearing device 1 and external power source 11 of a hearing system 100 according to the present invention in a high level schematic block diagram. The hearing device 1 comprises a power supply system 6 which supplies power to a sound system 2. The sound system 2 includes an input transducer 3 such as a microphone which picks up ambient sound and provides an input audio signal, which is processed by a signal processing unit 4 (such as analogue signal processing circuitry or a digital signal processor (DSP)) and subsequently output to the user of the hearing device 1 by an output transducer 5 such as a miniature loudspeaker (also commonly referred to as a receiver). Alternatively, the output transducer 5 can be a cochlear implant (CI), a bone-anchored hearing aid (BAHA) vibrational transducer or a direct acoustic cochlea stimulator (DACS). The input transducer 3 could alternatively be a telecoil (T-coil) or a wireless FM (frequency modulation) or Bluetooth receiver. Power is provided to the various electronic components of the sound system 2 by a power management unit 9. The power management unit 9 converts the battery voltage provided by a rechargeable battery 7 of the hearing device 1 to the voltages required by the various electronic components of the sound system 2, such as the input and output transducers 3, 5 and the signal processing unit 4. Furthermore, the power management unit 9 is capable of enabling and disabling the various electronic components of the sound system 2, such that these can put in a low-power, "sleep"/"standby" mode of operation in order to save power. Additionally, the power management unit 9 is adapted to control charging of the battery 7 by appropriately providing power from an external power source 11, e.g. the power management unit 9 is capable of controlling the voltage and current applied to the battery 7 during a charging cycle. Power (in the form of a power signal 12) can be provided from the external power source 11 for instance inductively as exemplified in FIG. 1 (or alternatively by means of capacitive coupling). Thereby, a receiver coil forms a power module 8 which receives the power signal 12 from the external power source 11, which includes a transmitter coil.

At the core of the present invention is a control unit 10, which is adapted to control the operation of the sound system 2 by means of a control output signal, dependent on a control input signal. The control input signal can depend on a type information provided by the external power source 11, which is indicative of the type of external power source 11 from which the power module 8 is receiving the power signal 12. The battery 7 of the hearing device 1 may for instance be charged by a desktop charger (=type "I") or by an auxiliary power pack (=type "II"). When the hearing device 1 is being charged using the desktop charger part or all of the electrical components of the sound system 2, e.g. certain amplifiers, filters, the signal processing unit 4 or the transducers 3, 5, may be switched off or put in sleep/standby mode. Alternatively, when the hearing device 1 is being charged using an auxiliary power pack the sound system 2 should operate, i.e. should also be provided with power. Instead of charging the battery 7 when an auxiliary power pack is attached to (or otherwise operationally connected with) the hearing device 1, in particular to the power module, which receives the power signal 12, the power from the auxiliary power pack may be exclusively used to power the sound system 2 and not at all to recharge the battery 7. Furthermore, the control input signal can additionally depend on a state of charge of the battery 7.

A variety of options exist to determine which type of external power source 11, e.g. stationary (type "I") or mobile/power pack (type "II"), is delivering the power signal 12. For instance the type information may be conveyed by the power signal 12 itself, e.g. it is provided as a modulation of the power signal 12. Alternatively, the type information may be provided by generating an electric or magnetic field or an optical signal. An appropriate sensor 13 in the hearing device 1 can then be employed to determine the type information. In the embodiment of the external power source 11 shown in FIG. 1 a permanent magnet is used to generate a static magnetic field, which can be detected by an appropriate magnetic sensor 13 in the hearing device 1, as soon as the hearing device 1 is in close proximity of the external power source 11. As another option the type information can be directly input by the user of the hearing device 1 via a user interface 15 at the hearing device 1 or at a separate hearing device accessory such as a remote control unit or smartphone.

Figure 2:
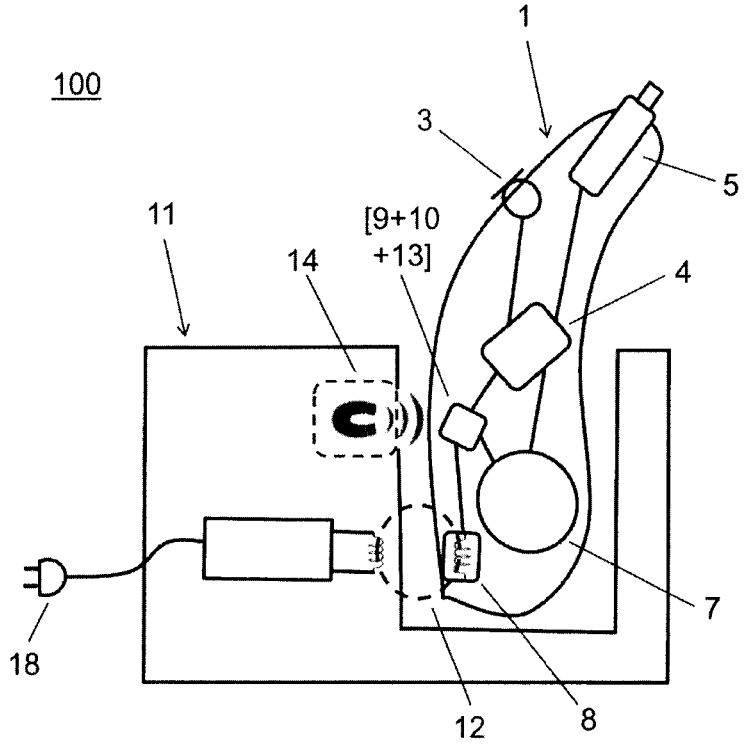
FIG. 2 depicts a schematic block diagram of an embodiment of a behind-the-ear hearing device according to the present invention as well as an embodiment of a stationary, desktop type of external power source according to the present invention.

FIG. 2 shows another high level schematic block diagram of a behind-the-ear (BTE) hearing device 1 and a desktop type (i.e. stationary) external power source or charging unit 11 according to the present invention. Once the hearing device 1 is placed into a receptacle in the charging unit 11 for receiving the hearing device 1 for charging, the sensor 13 in the hearing device 1 identifies the charging unit 11 as a desktop charger based on the sensed static magnet field generated by the permanent magnet 14 acting as an identification module for the external power source 11. Power is then transferred inductively from the charging unit 11 to the power module 8, which then charges the battery 7 while the sound system 2 is disabled (i.e. turned off) or at least put into a low power sleep/standby mode, since the hearing device 1 is not being used by the user during charging. During charging such a desktop charger 11 will itself be provided with power by connecting the charging unit 11 with the mains electric power via a cable and plug 18. In order to be able to distinguish between a multitude of different charger types for instance a modulated magnetic field generated by an electromagnet could be employed.

Figure 3:
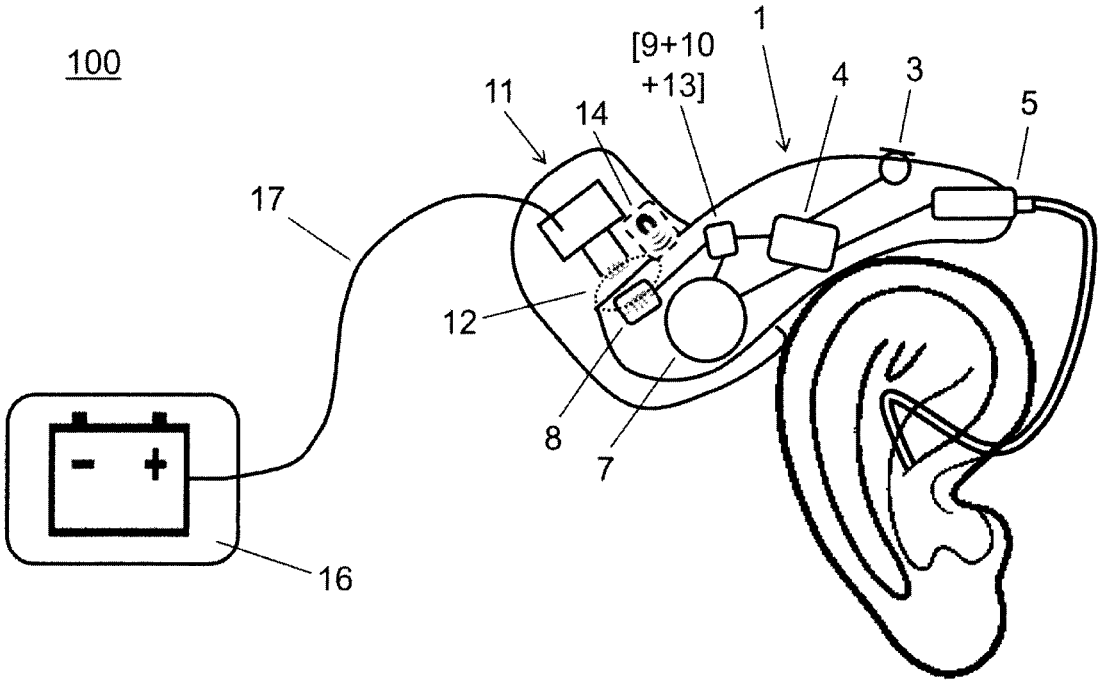
FIG. 3 depicts a schematic block diagram of an embodiment of a behind-the-ear hearing device according to the present invention as well as an embodiment of a portable/wearable type of external power source with a charging adapter according to the present invention.

FIG. 3 shows yet another high level schematic block diagram of a behind-the-ear (BTE) hearing device 1 and a portable/wearable type (i.e. mobile) external power source or charging unit 11 according to the present invention. Here the charging unit 11 is formed as a charging adapter adapted to be attachably arranged at the BTE hearing device 1 whilst the hearing device 1 is being worn and used by the user. A large rechargeable battery, i.e. a battery pack 16, is connected with the charging adapter via a cable 17. Likewise to FIG. 2, in the present embodiment the power is transferred inductively from the charger adapter to the power module 8, and the portable charging unit 11 is again identified by a magnetic sensor 13 in the hearing device 1. When the hearing device 1 is connected to a portable charger 11, e.g. an auxiliary power pack, the sound system 2 remains enabled, i.e. power is provided from the external power source 11 to the sound system 2 such that it is operable to provide the processed audio signal to the user. Some of the signal processing functionality may for instance not be active in order to save power, e.g. because the hearing device 1 has determined via a part of the type information that the charge level of the external battery of the charging unit 11 is low.

The invention claimed is:

1. A hearing device comprising:
an input transducer for providing an input audio signal;
a signal processing unit adapted to process the input audio signal and to provide a processed audio signal; and
an output transducer adapted to output the processed audio signal to a user of the hearing device,
a power supply system comprising:
a battery;
a power module adapted to receive a power signal from an external power source;
a power management unit adapted to receive power from either the power module or the battery, to provide power to an output transducer, and to charge the battery when a power signal is being received from an external power source; and
a control unit adapted to control operation of the hearing device by means of a control output signal dependent on a control input signal,
wherein the control input signal depends on a type information indicative of the type of the external power source from which the power module is receiving the power signal,
wherein the power management unit is adapted to support the following modes of operation:
provide power from the power module to the battery to charge the battery and simultaneously provide power to the sound system;
provide power from the power module to the battery to charge the battery and disable the sound system; and
provide power from the battery to power the sound system,
wherein the mode of operation to be employed is selected dependent on the control output signal.

2. The hearing device of claim 1, wherein the type information is derived from at least one of the following:
the power signal;
a user input provided by the user via a user interface; and
a signal provided by a sensor comprised in the hearing device, the sensor being adapted to detect information from an identification module comprised in the external power source.

3. The hearing device of claim 2, wherein is the hearing device is further adapted to adjust the processing performed by the signal processing unit dependent on the control output signal.

4. The hearing device of claim 1, wherein the power module is adapted to receive the power signal from the external power source via a charging cable, or wirelessly.

5. A hearing system, comprising:
an external power source comprising an identification module; and
a hearing device comprising:
an input transducer;
a signal processing unit;
an output transducer;
a battery;
a power module adapted to receive a power signal from the external power source;
a power management unit adapted to receive power from either the power module or the battery, adapted to charge the battery when a power signal is received from the external power source;
a control unit adapted to control operation of the hearing device by means of a control output signal dependent on a control input signal,
wherein the control input signal depends on a type information indicative of the type of external power source from which the power module is receiving the power signal,
wherein the power management unit is adapted to perform the following operations:
provide power from the power module to the battery to charge the battery while simultaneously powering the output transducer;
provide power from the power module to the battery to charge the battery and disable the sound system; and
provide power from the battery to power the sound system,
wherein the mode of operation to be employed is selected dependent on the control output signal.

6. The hearing system of claim 5, wherein the identification module comprising at least one of the following:
a magnetic field generator;
an electric field generator;
a light source; and
an radio frequency identification (RFID) chip.

7. The hearing system of claim 5, wherein the external power source is a mobile, portable or wearable unit, and wherein the external power source is connectable to a power supply.

8. The hearing system of claim 7, wherein the power supply is one of the following: a battery pack, a USB port, or a solar module.

* * * * *